United States Patent [19]

Levin

[11] 4,083,514

[45] Apr. 11, 1978

[54] YARN TENSIONING DEVICE

[76] Inventor: Nathan Levin, 416 Highgate Dr., Trenton, N.J. 08618

[21] Appl. No.: 682,714

[22] Filed: May 3, 1976

[51] Int. Cl.[2] ..... B65H 59/22

[52] U.S. Cl. ..... 242/152.1; 242/157 R; 248/214; 248/317

[58] Field of Search ..... 242/152.1, 147 R, 148, 242/149, 150 R, 150 M, 151, 152, 153, 154, 155 R, 155 M, 157 R, 131, 131.1, 106; 248/201, 207, 214, 317, 470

[56] References Cited

U.S. PATENT DOCUMENTS

| | | | |
|---|---|---|---|
| 2,373,513 | 4/1945 | Stevenson | 242/152.1 |
| 3,874,613 | 4/1975 | Zollinger | 242/152.1 |
| 4,017,038 | 4/1977 | Paepke | 242/152.1 |

*Primary Examiner*—Stanley N. Gilreath

[57] ABSTRACT

A yarn tensioning device for the continuous application of uniform tension to yarn of indefinite length as it runs through the device, the latter being of the type in which a freely rotatable ball serves to apply the tension to the yarn. The device has a housing with a cylindrically shaped yarn passageway extending vertically therethrough and in which a pair of spaced yarn eye guides of ceramic material are positioned. A ball is disposed in the passageway between the inserts so as to be seated atop the opening in the lower yarn eye guide. The diameter of the passageway is uniform and the wall of the housing is provided with a slot extending therethrough so that the yarn may be threaded through the slot and through each of the inserts thereby to thread the device with the yarn extending through the passageway and around the ball. The housing is provided with horizontal and vertical extending brackets by means of which the device may be mounted upon similarly extending surfaces. The housing is provided with diametrically opposed slots at its upper end for the insertion therethrough of a suitable lever to conveniently remove the upper yarn eye guide from the housing.

7 Claims, 7 Drawing Figures

YARN TENSIONING DEVICE

Figure 1:
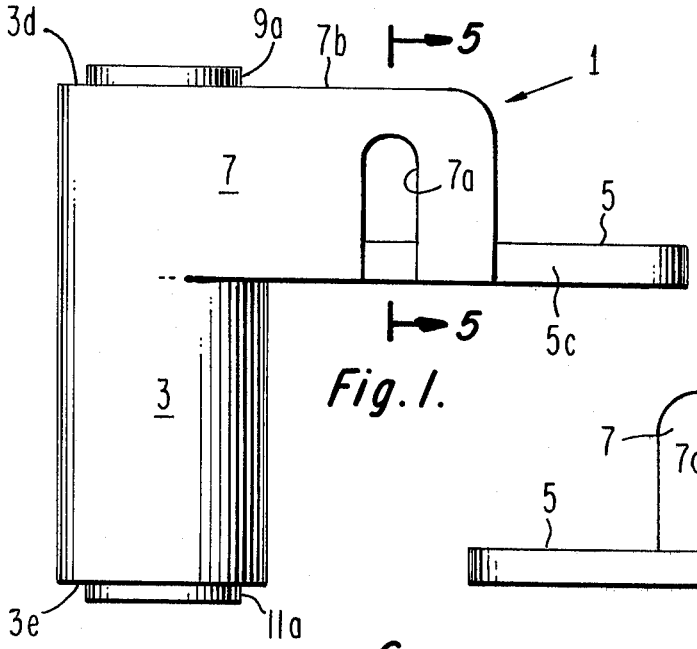
Figure 5:
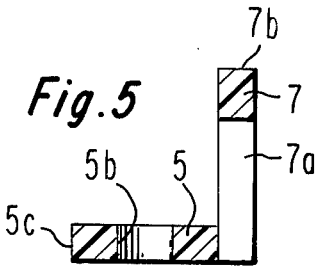

The present invention relates generally to the art of yarn tensioning and more particularly to an improved device for the continuous application of uniform tension to yarn of indefinite length as it runs through the device, the device being of the type wherein a ball serves to apply the tension to the running yarn.

The present application is for an improvement over my prior application Ser. No. 592,871, filed July 3, 1975, now U.S. Pat. No. 4,030,684.

Prior art ball tensioning devices have a housing with a tubularly shaped yarn passageway extending vertically therethrough, the passageway having sections of varying diameters. A ceramic yarn eye guide is received within the passageway at the lower end thereof and a ball is seated atop the yarn guide. The passageway sections restrain lateral movements of the ball and assist in the threading of the device. Examples of prior art ball tension devices are disclosed in U.S. Pat. Nos. 3,753,535, 3,874,613 and 3,892,371 to Zollinger.

It is a principal object of the present invention to provide a ball type of yarn tensioning device with a housing having a cylindrically shaped yarn passageway of generally uniform diameter extending therethrough, wherein spaced ceramic yarn eye inserts are positioned within the passageway adjacent the lower and upper ends thereof, and wherein a ball is disposed within the passageway in the space between the inserts, the ball being retained in seated position atop the lower insert by the interior surface of the passageway.

It is a further object of the present invention to provide means whereby the aforesaid yarn tensioning device may be readily threaded with the yarn to be tensioned thereby, such means comprising a suitably positioned opening of restricted size extending through the wall of the housing into the yarn passageway in such manner that the yarn may be readily threaded through the opening and the upper insert and through the opening and the lower insert whereby the yarn so threaded will extend through the inserts, through the passageway and around the ball therein.

It is a still further object of the present invention to provide the housing with brackets to mount the device upon vertical and horizontal surfaces, and to provide the housing with diametrically opposed slots in the upper end portion thereof for the convenient removal of the upper yarn eye guide from the housing.

With the above and other objects in view which will become apparent from the following detailed description of the embodiment of the invention shown in the accompanying drawings, the present invention resides in the novel elements of construction and arrangement of parts of the yarn tensioning device illustrated and as pointed out in the claims.

Figure 2:
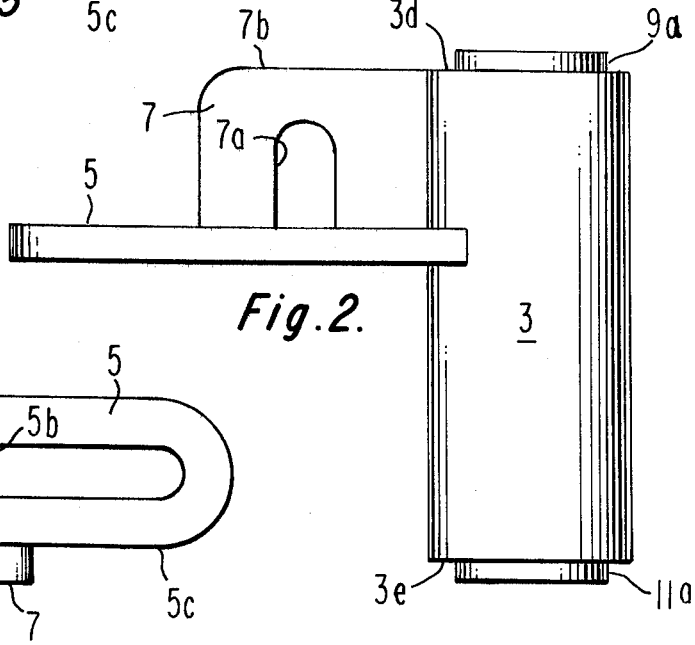
Figure 3:
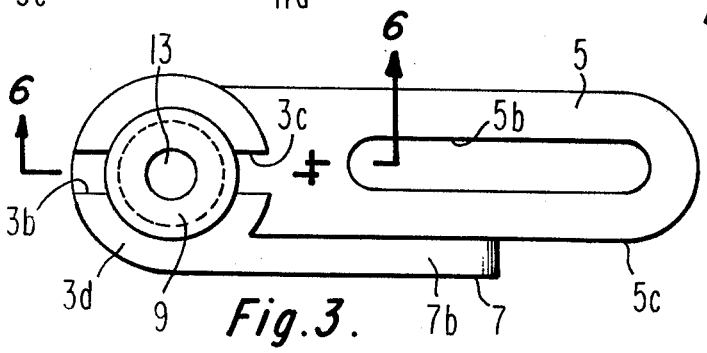
Figure 4:
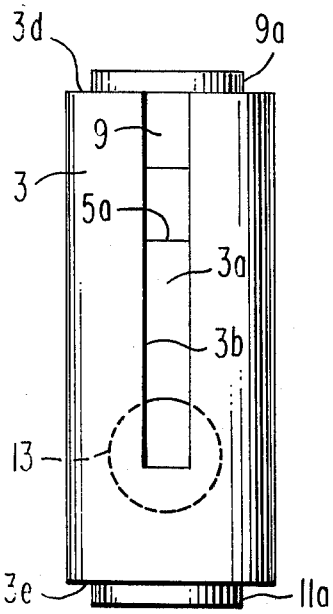
Figure 6:
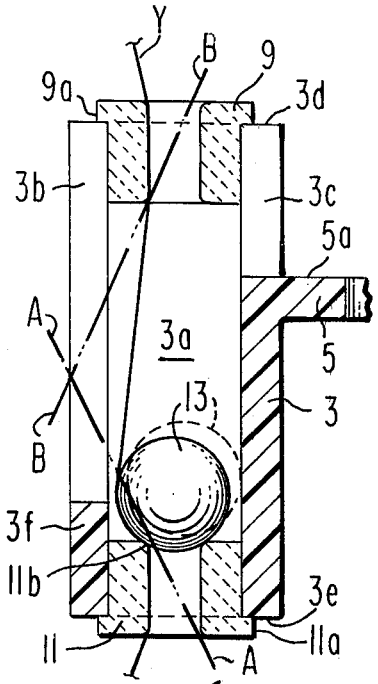
Figure 7:
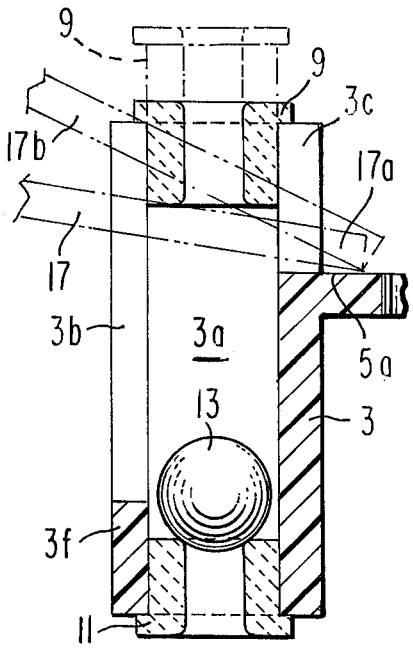

In the drawings:

FIG. 1 is a side elevational view of one side of the yarn tensioning device of the present invention, FIG. 2 is a side elevational view of the opposite side of the device shown in FIG. 1, FIG. 3 is a top plan view of the device shown in FIGS. 1 and 2, FIG. 4 is a front elevational view of the device shown in FIGS. 1, 2 and 3, FIG. 5 is a cross-sectional view of the device as taken on line 5—5 of FIG. 1, FIG. 6 is a cross-sectional view of the device as taken on line 6—6 of FIG. 3, and FIG. 7 is a view similar to FIG. 6 showing the removal of the upper yarn eye guide from the housing.

The ball tensioning device of the present invention is indicated generally at 1 in FIG. 1 of the drawings in which the device is shown in the upright position in which it is used. The device may be employed upon or in conjunction with any type of machine or apparatus in which running yarns are present to apply tension thereto, such as in knitting machines or the like.

The device is provided with a unitary structure or base, preferably of plastic material, made up of a tubularly shaped housing 3, a horizontally disposed bracket 5 and a vertically disposed bracket 7, the brackets extending rearwardly from and being joined to the housing and also being joined to each other. Tubularly shaped upper and lower ceramic yarn eye guide inserts 9 and 11 are received within the top and the bottom of the housing, and at least one ball 13 is disposed within the housing in position atop the lower yarn eye guide insert.

The housing 3 provides a cylindrically shaped passageway **3*a* therein for a running yarn Y to pass upwardly therethrough, the passageway being of uniform diameter and being open at both ends thereof. The wall of the housing is provided with diametrically opposed front and rear slots 3*b* and 3*c*, respectively, extending therethrough. Slot 3*b* extends downwardly from the upper end 3*d* of the housing to a point short of the lower end 3*e* thereof, thus leaving the housing with an unbroken band or ring 3*f* at its lower end. Slot 3*c* extends downwardly from upper end 3*d* of the housing to the upper horizontal surface 5*a* of bracket 5**.

The horizontal bracket 5, of suitable length, is provided with an elongated slot **5*b* formed therein, and by means of which the device may be adjustably mounted upon any suitable horizontal surface. One end of slot 5*b* is spaced from slot 3*c* of the housing to provide a surface 5*a* therebetween. The vertical bracket 7, of lesser length than bracket 5, is provided with an elongated slot 7*a* formed therein, and by means of which the device may be adjustably mounted upon any suitable vertical surface. Bracket 7 extends tangentially from the wall of the housing and is joined to edge 5*c* of bracket 5 to extend at a right angle thereto. The top 7*b* of bracket 7 is at a common level with the top 3*d* of the housing. The brackets 5, 7**, which are self reinforced as a result of the way they are joined to the housing and to each other, are preferably positioned at the upper portion of the housing.

Lower yarn eye guide insert 11 is received within the bottom portion of housing passageway **3*a* and is disposed within band portion 3*f* thereof, such guide having a yarn passageway extending therethrough and being shouldered as at 11*a* to abut against the bottom 3*e* of the housing. A similar upper yarn eye guide insert 13 is received within the top portion of housing passageway 3*a* and is disposed between slots 3*b*, 3*c* thereof, such guide having a yarn passageway extending therethrough and being shouldered as at 13*a* to abut against the top 3*d* of the housing. While the lower insert 11 may be more or less permanently secured in place in the housing by means of a force fit of such insert into band 3*f*, or by being glued therein, it is preferred that the upper insert 9** be yieldingly retained in the housing by the spring action of the upper ends of the spaced semicircular shaped walls of the housing acting upon such insert.

The ball 13 is seated atop lower insert 11 so as to extend across the upper end of the yarn passageway extending therethrough, the insert being rounded at 11*b* where contact is made with the ball. The ball is of predetermined diameter relative to the diameter of passageway 3*a* in the housing and to the diameter of the passageway in insert 11. The ball diameter may vary so long as it is sufficiently greater than the diameter of the passageway in insert 11 so that the ball can remain seated atop the latter, and so long as it is of sufficient diameter to permit a yarn to pass between it and the interior surface of passageway 3*a*, and so that the latter surface will sufficiently restrain lateral movements of the ball so that the force of gravity acting upon the ball will cause it to remain in seated position atop the insert 11. The ball, preferably of hardened stainless steel, is of predetermined weight to apply a desired amount of tension to yarn Y, FIG. 6, as it passes upwardly through the device from its source, through insert 11, passing between the latter and the ball resting thereon to apply tension to the moving yarn, passing around the ball, through passageway 3*a*, and passing through insert 9, to its destination. One or more balls, of desired weight and diameter, may be placed atop the ball 13 in the housing to correspondingly adjust the tension applied to the yarn.

The present ball tension may be readily threaded in two steps with the use of a relatively thin elongated instrument having a hook at one end thereof, such as a latch knitting needle. In step one, the hook end of the istrument is inserted, along line A—A, FIG. 6, through slot 3*b* in the housing and through lower insert 11, to engage the yarn Y and, as the instrument is withdrawn from the housing, to pull it through insert 11 and through slot 3*b*. Then, in step two, the instrument is inserted, along line B—B, FIG. 6, through upper insert 9 and through slot 3*b* in the housing, to engage the yarn Y (previously pulled through slot 3*b* in step one) and, as the instrument is withdrawn from the housing, to pull it through slot 3*b* and through upper insert 9, thereby threading the device. It will be obvious that the order as well as the direction of pulling the yarn along the lines A—A, B—B may be varied in threading the device. The ball will be moved upwardly, to its dotted line position, as it is displaced by the instrument moving along line A—A. While the width of slot 3*b* is sufficient to permit passage of the yarn and of the instrument therethrough, it is not sufficient to permit passage of the ball therethrough. The presence of the slot 3*b* does not prevent lateral restraint of the ball by the interior surface of passageway 3*a*.

Upper insert 9 may be conveniently removed from the housing to permit unobstructed entry into passageway 3*a*. To do this, a relatively long and narrow instrument 17, FIG. 7, such as a screw driver or the like, is first inserted through slots 3*b*, 3*c* of the housing with its end 17*a* resting upon surface 5*a* of bracket 5. Then, the instrument is lifted to its dotted line position 17*b*, with end 17*a* still in contact with surface 5*a*, thereby to pry up the insert 9 to its dotted line position for removal from the housing.

I claim:

1. A yarn tensioning device having a housing of predetermined length, said housing having a yarn passageway extending lengthwise therethrough with said passageway positioned vertically when said device is in its operative position, said device having means within said passageway to apply tension to and to guide a moving yarn passing through said passageway, and a first and a second mounting bracket for said device, said brackets being formed integrally with and extending laterally from said housing, said first bracket extending parallel to a horizontal plane and said second bracket extending parallel to a vertical plane when said device is in its said operative position, said brackets intersecting at right angles and being integrally joined at such intersection, said brackets having slots formed therein, whereby said brackets can be used to mount said device in its said operative position upon horizontal and upon vertical surfaces.

2. A device as in claim 1 wherein said housing and said second bracket terminate in a common plane extending at right angles to said vertical plane.

3. A device as in claim 2 wherein said housing is cylindrically shaped, and wherein said second bracket extends tangentially from said housing.

4. A yarn tensioning device having a housing of predetermined length, said housing having a yarn passageway extending lengthwise therethrough with said passageway extending vertically when said device is in its operative position, said device having means within said passageway to apply tension to and to guide a moving yarn passing through said passageway, said means including a yarn eye guide insert of predetermined length received within the uppermost portion of said passageway, the corresponding uppermost portion of said housing having a pair of spaced lengthwise positioned slots of predetermined length extending therethrough and in communication with said uppermost portion of said passageway, the disposition of said slots permitting said insert to be positioned in said slotted portion of said housing, and the length of each of said housing slots exceeding the length of said insert in such manner that while said insert acts to obstruct the space extending through the upper portion of said housing slots and across the intervening portion of said passageway for the length of said insert, the remaining lower portions of each of said housing slots provides an unobstructed space extending therethrough and across the intervening portion of said passageway adjacent to said insert.

5. A yarn tension device as in claim 4, said device having a mounting bracket formed integrally with and extending laterally from said housing, said bracket extending parallel to a horizontal plane with one of said housing slots disposed between the upper end of said housing and said bracket whereby said unobstructed space also extends across said bracket, and said bracket having means for the mounting of said device upon a horizontal surface.

6. A device as in claim 1 wherein said housing is cylindrically shaped, and wherein said second bracket extends tangentially from said housing.

7. A device as in claim 1 wherein said slot in said second bracket is an open-ended slot with the open end thereof extending fully across said intersection of said brackets.

* * * * *